US010001097B2

(12) United States Patent
Jay et al.

(10) Patent No.: US 10,001,097 B2
(45) Date of Patent: Jun. 19, 2018

(54) FUEL INJECTION APPARATUS, A PISTON ENGINE AND METHOD OF OPERATING A PISTON ENGINE

(75) Inventors: David Jay, Vahakyro (FI); Holmer Slocinski, Stuttgart (DE)

(73) Assignee: WARTSILA FINLAND OY, Vaasa (FI)

( * ) Notice: Subject to any disclaimer, the term of this patent is extended or adjusted under 35 U.S.C. 154(b) by 282 days.

(21) Appl. No.: 13/885,450

(22) PCT Filed: Dec. 5, 2011

(86) PCT No.: PCT/FI2011/051076

§ 371 (c)(1),
(2), (4) Date: May 15, 2013

(87) PCT Pub. No.: WO2012/076753

PCT Pub. Date: Jun. 14, 2012

(65) Prior Publication Data

US 2013/0284151 A1 Oct. 31, 2013

(30) Foreign Application Priority Data

Dec. 10, 2010 (FI) ..... 20106310

(51) Int. Cl.
*F02M 69/46* (2006.01)
*F02M 47/04* (2006.01)
(Continued)

(52) U.S. Cl.
CPC ..... *F02M 47/043* (2013.01); *F02M 47/027* (2013.01); *F02M 53/043* (2013.01);
(Continued)

(58) Field of Classification Search
USPC ..... 123/445, 447, 456, 464, 468, 469, 470, 123/540, 541, 542, 578; 239/584
See application file for complete search history.

(56) References Cited

U.S. PATENT DOCUMENTS 6,056,912 A 5/2000 Rembold et al.
6,427,968 B1 * 8/2002 Stoecklein ..... F02M 45/04 251/129.06

(Continued)

FOREIGN PATENT DOCUMENTS

DE 102005028601 A1 12/2006
EP 1686257 A2 8/2006

(Continued)

OTHER PUBLICATIONS

International Search Report for PCT/FI2011/051076 dated Apr. 20, 2012.

(Continued)

*Primary Examiner* — Lindsay Low
*Assistant Examiner* — Ruben Picon-Feliciano
(74) *Attorney, Agent, or Firm* — Heslin, Rothenberg, Farley & Mesiti P.C.; Victor Cardona

(57) ABSTRACT

A fuel injection apparatus for a piston engine includes a fuel injector body in which an injector needle is provided, which injector needle is arranged to prevent or allow fuel injection flow from the injection apparatus based on the position of the injector needle. The position is effected by a pressurized control fluid so that by applying the pressurized control fluid the needle may be urged towards its closed position and by reducing the pressurized control fluid the needle may be allowed to move away from its closed position. The injection apparatus includes a flow path for the control fluid, wherein the flow path for the control fluid comprises a restriction section providing a restriction effect to the control fluid flow. The restriction section includes at least one temperature-effected member providing a temperature-dependent restriction effect.

9 Claims, 3 Drawing Sheets

(51) Int. Cl.

| | |
|---|---|
| ***F02M 47/02*** | (2006.01) |
| ***F02M 53/04*** | (2006.01) |
| ***F02M 55/00*** | (2006.01) |
| ***F02M 61/16*** | (2006.01) |
| ***F02M 61/18*** | (2006.01) |

(52) U.S. Cl.

CPC ..... *F02M 55/008* (2013.01); *F02M 61/166* (2013.01); *F02M 61/167* (2013.01); *F02M 61/18* (2013.01); *F02M 2200/25* (2013.01); *F02M 2200/28* (2013.01); *F02M 2200/9007* (2013.01)

(56) References Cited

U.S. PATENT DOCUMENTS

| | | | | |
|---|---|---|---|---|
| 2005/0140072 | A1* | 6/2005 | Schurz | F02M 51/0603 267/64.27 |
| 2005/0258266 | A1* | 11/2005 | Elia | F02M 43/04 239/5 |
| 2006/0016906 | A1* | 1/2006 | Matsumoto | 239/102.2 |
| 2007/0090724 | A1* | 4/2007 | Kato | F02M 47/027 310/311 |
| 2007/0209638 | A1* | 9/2007 | Becker | F02M 55/002 123/445 |
| 2007/0246561 | A1* | 10/2007 | Gibson | 239/5 |
| 2010/0288850 | A1* | 11/2010 | Ibrahim et al. | 239/132 |
| 2012/0103308 | A1* | 5/2012 | Hefler | F02M 47/027 123/447 |

FOREIGN PATENT DOCUMENTS

| | | | |
|---|---|---|---|
| EP | 1884655 | A1 | 2/2008 |
| EP | 2439397 | A2 | 4/2012 |
| GB | 2309490 | A | 7/1997 |
| WO | 01/14736 | A1 | 3/2001 |

OTHER PUBLICATIONS

Written Opinion of the International Preliminary Examining Authority for PCT/FI2011/051076 dated Nov. 12, 2012.

* cited by examiner

FUEL INJECTION APPARATUS, A PISTON ENGINE AND METHOD OF OPERATING A PISTON ENGINE

CROSS-REFERENCE TO RELATED APPLICATIONS

This application is a 371 National Phase of International Application Number PCT/FI2011/051076 filed on Dec. 5, 2011, and published in English on Jun. 14, 2012 as International Publication Number WO 2012/076753 A1, which claims priority to Finnish Patent Application No. 20106310, filed on Dec. 10, 2010, l the entire disclosures of which are incorporated herein by reference.

TECHNICAL FIELD

The present invention relates to fuel injection apparatus for internal combustion piston engines and to fuel injection rate shaping. The invention relates also to a piston engines and method of operating a piston engine.

BACKGROUND ART

Internal combustion engines are generally provided with fuel injection systems in which the pressurizing of the fuel and the control of injection are separated. In such systems an accumulator volume is used as a storage of pressurized fuel the admission of which into a combustion chamber is accomplished by means of a valve needle in the fuel injector nozzle. These systems are commonly known as common rail fuel injection systems.

The pressure and quantity of the fuel supplied into the nozzle has also significance for the quantity and quality of the combustion gases generated by the combustion process, which gases eventually load the environment. Therefore, the aim has been to control the fuel flow rate and pressure within the feed line by means of various, relatively complicated, electronic systems.

In common rail system the control of the valve needle is typically accomplished by making use of the fuel pressure acting against a surface of the needle in a direction of opening and/or closing the needle. In a typical common rail system the injection pressure reaches a high pressure level almost immediately when the valve needle starts rising in the injector nozzle.

Consequently, fuel is injected into the combustion space so that the mass flow is extremely voluminous from the very start of the injection. In this case, the cylinder pressure may rise too fast for achieving an optimum performance. Thus, the maximum pressure shown by the injection pressure curve (the pressure in the nozzle at various moments of time during the injection process) is generally reached too early. In addition, the reduction of the injection pressure takes time before the start of the next injection.

In order to control the rate of the increase of the pressure it is known to utilize so-called rate shaping of fuel injection by means of a rate shaping device.

EP 1686257 A2 discloses fuel injector in which the valve needle is controlled by means of subjecting the fuel pressure against the needle surface both into the opening and the closing direction at which situation the needle is maintained closed. In the event of injection the fuel pressure acting against the needle surface in the closing direction is relieved by opening a spill port in the nozzle, which causes a change in the balance of forces and thus movement of the needle. EP 1686257 A2 discloses also a rate shaping system which restricts the fuel flow during the initial portion of an injection event and causes a greater flow of fuel during a later portion of the injection event. In this arrangement the rate shaping is based on changing the restrictions provided in a main fuel line leading fuel to a sac of the injector.

Even if this fuel injector may be fit to use as such there has emerged a need for more precise control of the rate shaping functionality. Therefore it is an object of the invention is to provide a fuel injection apparatus for a piston engine which operates better in various operation conditions of the engine.

DISCLOSURE OF INVENTION

Objects of the invention are met by a fuel injection apparatus for a piston engine comprising a fuel injector body in which an injector needle is provided, which injection needle is arranged to prevent or allow fuel injection flow from the injection apparatus based on the position of the injector needle, which position of the injector needle is effected by a pressurized control fluid so that by applying the pressurized control fluid the needle may be urged towards its closed position and by reducing the pressurized control fluid the needle may be allowed to move away from its closed position, the injection apparatus further comprising a flow path for the control fluid, wherein the flow path for the control fluid comprises a restriction section providing a restriction effect to the control fluid flow. It is characteristic of the invention that said restriction section comprises at least one temperature-effected member providing a temperature-dependent restriction effect.

This way the fuel injection rate shaping may be accomplished by means of the different restriction effect of the restriction section at different temperatures. The temperature of the restriction section may be changed by changing the temperature of the fuel.

According to an embodiment of the invention the restriction section has at least one surface defining the flow path for the control fluid, and the at least one surface comprises at least two co-operative temperature-effected members, the first member of which has different coefficient of thermal expansion than the second member of the members.

According to an embodiment of the invention the first member is of ceramic material and the second member of steel. The ceramic material provides also improved wear resistance in use.

Since the position of the injector needle is effected by the pressurized control fluid, so that by applying the pressurized control fluid the needle may be urged towards its closed position and by reducing the pressurized control fluid the needle may be allowed to move away from its closed position, effecting the rate shaping operation to the control may not cause disadvantageous effects to the actual fuel flow through the injector to the combustion chamber.

According to another embodiment of the invention the fuel injector body comprises an injector space, into which the injector needle is arranged, which injector space is provided with a fuel inlet port and fuel injection spray hole orifices at a first end of the injector space, through which the fuel may be injected under control of the injector needle, and in which a second end of the injector needle is arranged to border a control space, which control space belongs to the flow path for the control fluid into which the restriction section is arranged.

The control space is advantageously bordered by a collar part encircling at least partly the injector needle. According to a preferred embodiment the control space is bordered by a collar part which encircles at least partly the end of the injector needle. The restriction section comprises the counter surfaces of the injector needle and the collar part.

Advantageously the collar part is of different material to that of the injector needle.

According to another embodiment of the invention a separate control plate is arranged into the collar part which control plate is provided with an orifice and the restriction section comprises the orifice in the control plate and the second constriction in the outlet channel of the valve plate, which control plate has different coefficient of thermal expansion than the valve plate.

A piston engine having a common rail fuel injection system in which the common rail fuel injection system comprises a fuel injector body in which an injector needle is provided, which needle is arranged to prevent or allow the fuel injection flow from the injector based on its position and in which the position of the injector needle is effected by pressurized control fluid so that by applying the pressurized control fluid the needle may be urged towards its closed position and by reducing the pressurized control fluid the needle may be allowed to move away from its closed position, and which injection apparatus further comprising a flow path for the control fluid, the pressure state of which control fluid has effect on the position of the injector needle and the flow path for the control fluid comprises a restriction section providing a restriction effect on the control fluid flow. It is characteristic of the invention that said restriction section comprises at least one temperature-effected member providing a different restriction effect at different temperature.

According to an embodiment of the invention the piston engine comprises a cooling system arranged in operational vicinity of the fuel injection apparatus.

According to further embodiment of the cooling system is arranged in operational vicinity of the body of the fuel injection apparatus.

The invention relates also to a method of operating a piston engine with a common rail fuel injection system comprising a fuel injector body in which an injector needle is provided, in which method the piston engine is operated so that after starting the engine, emission of at least one predetermined substance is measured from the exhaust gases of the engine, and at least until the engine has reached its normal operational temperature the cooling system of the engine is controlled to have effect on the temperature of the fuel and/or the fuel injection apparatus in order to control the at least one temperature-effected member providing a temperature dependent restriction effect on the control fluid flow effecting on the position of the injector needle.

BRIEF DESCRIPTION OF DRAWINGS

In the following, the invention will be described with reference to the accompanying exemplary, schematic drawings, in which.

DETAILED DESCRIPTION OF DRAWINGS

Figure 1:
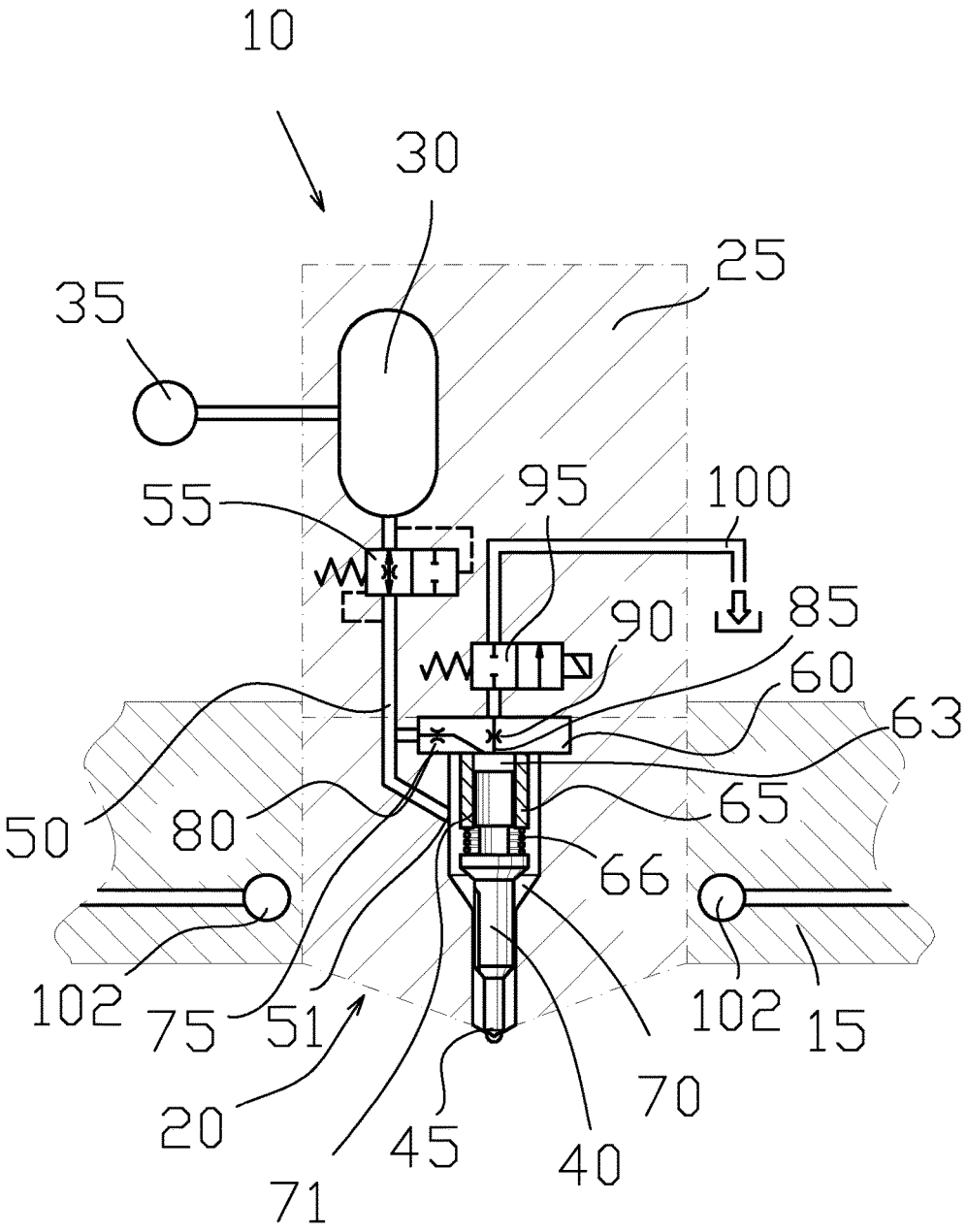
FIG. 1 illustrates an embodiment of the invention.

FIG. 1 show schematically a fuel injection system 10 installed in a cylinder head 15 in a piston engine. The fuel injection system 10 comprises a fuel injection apparatus 20 by mean of which the fuel is fed into the combustion chamber of the engine. In the embodiment of FIG. 1 the fuel injection apparatus 20 is incorporated into a fuel injector body 25. The fuel injection apparatus includes a fuel accumulator space 30, which is in connection with a source of pressurized fuel 35 belonging to the fuel injection system 10. The fuel injector body 25 is provided with a fuel space 70 into which an injector needle 40 is arranged. The injector needle 40 has a tip 45 at its first end by means of which the injector needle 40 is arranged to prevent or allow the fuel injection flow into the combustion chamber by closing or opening a flow connection between the fuel injection spray hole orifices (46 in FIG. 3, not shown in the FIG. 1) and the fuel space in the fuel injector body 25. The injector needle may be built of one or several successive parts as can be seen particularly in the FIG. 3. At the second end of the injector needle which is the upper end when the needle is in the position shown in the FIGS. 1 and 3 there is a collar part 65 into which the second end of the injector needle 40 extends. The space inside the collar part 65 and above the injector needle border a control space 63 of the system. The collar has a cylindrical inner space and the second end of the injector needle 40 has a cylindrical outer surface and they have a common central and longitudinal axis.

The accumulator space 30 within the fuel injector body 25 is in flow connection with the fuel space 70 in the injector through a main fuel channel 50 arranged to the injector body 25. The main fuel channel opens into the fuel space 70 through an inlet port 51. There is also a flow fuse 55 arranged to the channel 50. The flow fuse is arranged to allow only a limited amount of continuous fuel flow blocking the fuel flow for example in the case of malfunction of the system. As is apparent from the FIG. 1, the pressure of the accumulator 30 comes over to the fuel space 70 due to the connection of the main channel 50. Above the fuel space 70 there is arranged a valve plate 60. The valve plate borders the upper part of the fuel space 70.

The valve plate is provided with a connection channel 75 which connects the main channel 50 to the space inside the collar part 65. The connection channel 75 is provided with a first constriction 80 the purpose of which will be explained later. The valve plate 60 is additionally provided with an outlet channel 85 which opens also into the space inside the collar part 65. The outlet channel 85 is provided with a second constriction 90 through which the outlet channel 85 connects to a valve member 95. The valve member is preferably an on-off solenoid valve and it separates connectably a high pressure part 30, 35, 70 and a low pressure part 100 of the fuel injection system 10 from each other.

The collar part 65 is pressed against the valve plate 60 by a needle spring 66 which is supported between the collar part 65 and the injector needle 40.

The fuel injection system 10 is operated so that the source of pressurized fuel maintains the fuel accumulator volume 30 filled with fuel at a predetermined pressure. When the valve member i.e. the solenoid 95 opens a flow communication between the outlet channel 85 and the low pressure part 100 of the system the pressure in the chamber or space inside the collar part 65 and above the second end of the injector needle 40 decreases rapidly. This may take place due to the fact that the first constriction 80 has a first area for fuel flow that is smaller than a second area of the second constriction 90 in the outlet channel 85. Decreasing the pressure inside the collar part 65 and above the second end of the injector needle 40 while the pressure in the fuel space 70 is maintained substantially unchanged changes the balance of forces acting against the injector needle 40 in the direction of its longitudinal axis causing it to move towards the valve plate 60 and opening a flow connection between the fuel injection spray hole orifice and the fuel space 70.

The collar part 65 is pressed tight against the valve plate 60 during the whole injection cycle, as the pressure in the fuel space 70 acts from underneath to ensure closure and tightness against the valve plate 60. The needle spring 66 assists in holding the collar static and pressure tight against the valve plate.

A small gap 71 between the collar part 65 and the needle 40 allows some leakage fuel to flow from the fuel space 70 which assists lubrication between the reciprocating needle and the stationary collar part.

As is explained above the position of the injector needle 40 is effected by pressurized control fluid, which in this embodiment is the fuel. It is apparent to a person skilled in the art that the control fluid may also by some other suitable pressure medium, like hydraulic oil, but it is advantageous to utilize the fuel pressurized already for the injection event. Thus by applying the pressurized fuel the needle may be urged towards its closed position and by reducing the pressurized control fluid the needle may be allowed to move away from its closed position.

The injections may be executed according to an embodiment of the invention at a reduced initial injection rate despite the high-pressure fuel injection system 10, which provides a potential to reduce particulate, $NO_x$ and noise emissions simultaneously. This may be accomplished by restricting the control fluid flow when the control fluid pressure is reduced and the needle 40 is allowed to move away from its closed position.

In the embodiment of FIG. 1 a flow path for the control fluid, the pressure state of which control fluid has effect on the position of the injector needle, is formed by the combination of the connection channel 75 and the first constriction 80, the outlet channel 85 and the second constriction 90 and the gap between the collar part 65 and the needle 40. In order to provide a rate shaping functionality the flow path comprises at least one section providing a restriction effect to the control fluid flow, in this case three restrictions i.e. the first and the second constrictions and the gap which all have an effect on the depressurizing or the space 63 inside the collar part 65.

In the embodiment of FIG. 1 the collar part 65 and at least the second end of the injector needle 40 are of materials having different thermal expansion coefficients being an embodiment of a temperature-effected member providing a different restriction effect at different temperatures.

In this embodiment particularly the inner surface of the collar part 65 and the outer surface of the injector needle 40 define the flow for the control fluid in which the two opposite temperature-effected members cause the gap between them to change according to the prevailing temperature. This in turn has effect on the flow rate of the fuel from the fuel space 70 through the gap to the space 63 inside of the collar part 65 and the depressurizing thereof.

The cylinder head 15 is provided with a cooling system 102 arranged in operational vicinity of the fuel injection apparatus 20 including fluid flow channels in the cylinder head, especially in the vicinity of the body of the fuel injection apparatus, By means of cooling system it is possible have effect on the temperature of the fuel and/or the fuel injection apparatus 10 in order to control the at least one temperature-effected member 40, 65, 71. Cooling apparatus may include fluid flow channels arranged also to the injector body 25 (not shown).

Figure 2:
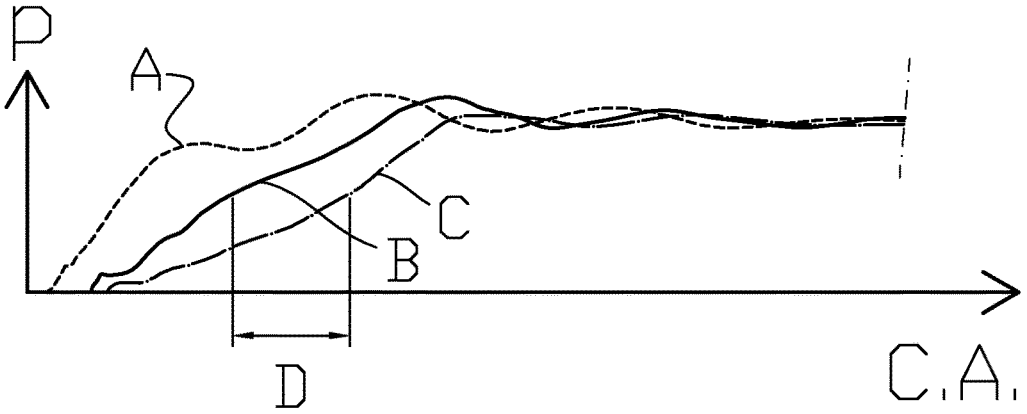
FIG. 2 illustrates examples of rate shaping functionality according to an embodiment of the invention.

Now turning to FIG. 2 one can see the exemplary situation in which the effect of the temperature-effected member of FIG. 1 is illustrated. The vertical axis represents the injection pressure p and the horizontal axis represents the crank angle C.A. of the engine. The curves show the pressure increase at the beginning of the injection. The curve A represents a case in which the collar part 65 and the injector needle 40 are both made of steel thus being of identical temperature characteristics, particularly of identical thermal expansion coefficient. The curve A is shown here as a reference. The curve B represents a case in which the collar part 65 and the injector needle 40 are of different material. Particularly the collar part 65 is of ceramic material, such as tungsten carbide or silicon nitride and the injector needle is of steel. In this example of the fuel temperature is about 140° C. The curve C represents also a case in which the collar part 65 is of ceramic material, and the injector needle is of steel. In this example of the fuel temperature is about 40° C.

As can be seen from the FIG. 2, when running the engine with a lower temperature the increase of the injection pressure is considerably more gently sloping. As an example, the change represent at a certain pressure a delay D of 1,9° C.A. This has particularly an advantageous effect while running the engine under the normal operating temperature e.g. just after starting the engine. At this stage the emission controls equipment, particularly the NOx catalytic converter has not yet reached its working temperature and by means of the present invention the temperature-effected fuel injection rate shaping has an advantageous effect on this problem.

According to an embodiment of the invention a piston engine is operated so that after starting the engine, the emission of at least one predetermined substance is measured from the exhaust gases of the engine and at least until the engine has reached its normal operational temperature the cooling system of the engine is controlled to effect on the temperature of the fuel and/or the fuel injection apparatus 10 in order to control the at least one temperature-effected member 65 providing a temperature-dependent restriction effect on the control fluid flow.

Figure 3:
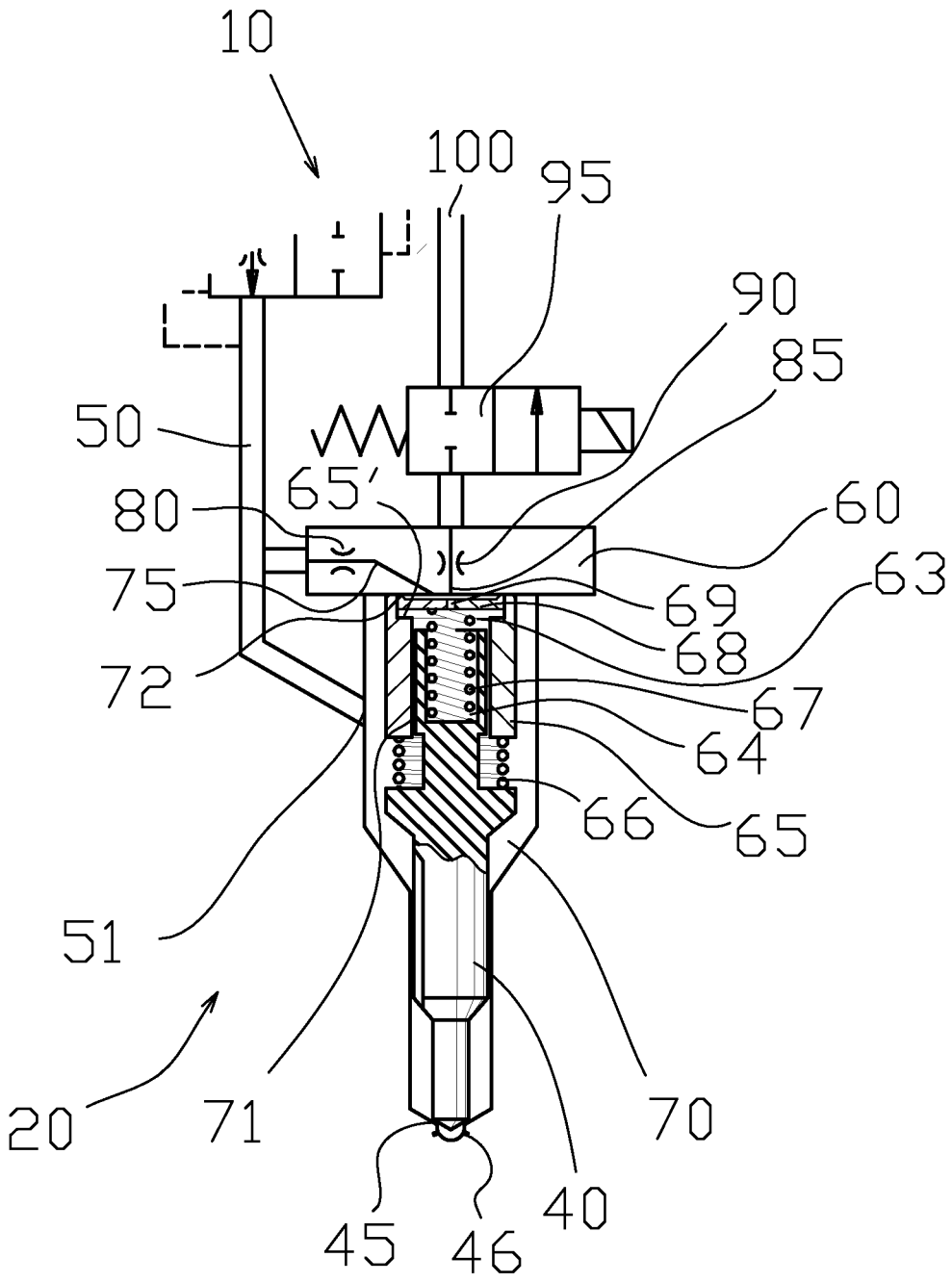
FIG. 3 illustrates another embodiment of the invention.

FIG. 3 shows a fuel injection system 10 according to another embodiment of the invention. It corresponds to the embodiment of FIG. 1 otherwise except for the details relating to the control space 63 inside the collar part 65 and thus the same reference numbers are used for same or corresponding elements.

In the embodiment of FIG. 3 the second end of the injector needle 40, i.e. the upper end in the position of FIG. 3, is provided with a cylindrical cavity 64, like a bore drilling forming a control space 63. There is a control plate 68 arranged between the second end of the injector needle 40 and the valve plate 60 supported by a spring 67 between them. The control plate has an aperture or an orifice 69 extending from its first side i.e. the side of the injector needle, to a second side i.e. the side of the valve plate 60, in the longitudinal axis of the injector needle 40. The control plate 68 is also provided with a space on the second side bordered by a rim 72 at the periphery of the control plate 68 encircling the cavity. The connection channel 75 and outlet channel 85 open into the space. There is a radial reduction 65' at the end of the collar part 65 which forms a shoulder to the collar part 65. The control plate 68 has a diameter greater than the inner diameter of the collar part 65 so that the shoulder formed by the reduction 65' limits the movement of the control plate. The longitudinal height of the reduction is greater than the thickness of the control plate 68 in the longitudinal axis of the injector needle 40.

In the rest position before the injection starts, the control plate 60 is sealed against the valve plate 60 by the rim 72.

When the valve member 95 is activated, the depressurizing of the control space 63 is commenced. The fuel escape from the pressurized control space inside the collar part 65 is controlled by the orifice 69 in the control plate 68 together with the second constriction 90 in the outlet channel 85. This enables a slower needle lifting ramp and hence a lower injection pressure rise.

Additionally in the embodiment of FIG. 3 the flow path for the control fluid comprises the gap 71 between the collar part 65 and the needle 40. In order to change the rate shaping functionality the flow path comprises at least one section having different thermal expansion coefficients, being an embodiment of a temperature-effected member providing a different restriction effect at different temperatures. The collar part 65 and at least the second end of the injector needle 40 are of materials having different thermal expansion coefficients providing a changing restriction effect to the control fluid flow.

A closing sequence starts when the valve member 95 is closing the flow out via the orifice 69 in the control plate. Advantageously the valve member 95 is a solenoid valve. At the initial phase the control plate 68 is against the valve plate 60 and the fuel flows only through the orifice 69. As the flow via the orifice 80 continues through the orifice 69 to the cavity 64 or control space 63, the pressure in the control space 63 acting on top of the needle 40 causes the needle to start its closing movement. The force caused by pressure in the cavity 64 and the force of the spring 67 decreases below the force caused by the pressure in the space at the second side of the control plate 68 bordered by a rim 72 and the valve plate 60. At this stage the control plate 68 departs from contact with the valve plate 60 and the fuel may flow around the control plate 68. This allows a considerable increase in the fuel flow into the control space 63 urging the needle to its closed position. In the closing sequence the control plate 68 is floating between the second end of the injector needle 40 and the valve plate 60. The gap between the control plate and the collar part is big enough to allow flow of control fluid in an amount of pushing the needle downwards fast enough without the plate 68 following. Thus the orifice 69 does not retard the closing sequence after the initial phase at all.

According to an embodiment of the invention, the collar part 65 is of different material than the injector needle i.e. ceramic material as in FIG. 1.

While the invention has been described herein by way of examples in connection with what are, at present, considered to be the most preferred embodiments, it is to be understood that the invention is not limited to the disclosed embodiments, but is intended to cover various combinations or modifications of its features, and several other applications included within the scope of the invention, as defined in the appended claims. The details mentioned in connection with any embodiment above may be used in connection with another embodiment when such combination is technically feasible.

The invention claimed is:

1. A fuel injection apparatus for a piston engine comprising:

a fuel injector body in which an injector needle is provided, which injector needle is arranged to prevent or allow fuel injection flow from an injection apparatus based on a position of the injector needle, which position is effected by a pressurized control fluid in a control space;

the fuel injector body comprising an injector space, into which the injector needle is arranged, which injector space is provided with a fuel inlet port and fuel injection spray hole orifices at a first end of the injector space, through which the fuel may be injected under control of the injector needle, wherein a second end of the injector needle is arranged to border the control space, which control space is connectable with a low pressure side of the fuel injection system via a flow path for the control fluid, wherein the flow path for the control fluid comprises a restriction section for restricting a flow of the control fluid, the restriction section bounded by a valve plate and a control plate, and wherein the control plate is separate from and movably received in a collar part, the control plate sealingly engageable with the valve plate to seal the control space in an non-injection position, the control plate comprises an orifice, the collar part bounding the control space when the control plate is completely separated from the valve plate, the collar part at least partially circumferentially surrounding the injection needle, the restriction section comprising the orifice in the control plate and an outlet channel of the valve plate, the control plate having a different coefficient of thermal expansion than the valve plate allowing a change in a restriction effect of the restriction section in response to a change of a temperature of the valve plate and the control plate.

2. A fuel injection apparatus according to claim 1, wherein the control space is bordered by the collar part encircling at least partly the injector needle.

3. A fuel injection apparatus according to claim 2, wherein the collar part encircles at least partly an end of the injector needle.

4. A fuel injection apparatus according to claim 2, wherein the restriction section comprises a gap between the outer surfaces of the injector needle and the collar part.

5. A fuel injection apparatus according to claim 1, wherein the first member is of ceramic material and the second member is steel.

6. A piston engine having a common rail fuel injection system, wherein the common rail fuel injection system comprises a fuel injection apparatus according to claim 1.

7. A piston engine according to claim 6, wherein the piston engine comprises a cooling system arranged in operational vicinity of the fuel injection apparatus.

8. A piston engine according to claim 7, wherein the piston engine comprises a cooling system arranged in operational vicinity of the body of the fuel injection apparatus.

9. A method of operating a piston engine with a common rail fuel injection system comprising a fuel injector apparatus according to claim 1, in which method the piston engine is operated so that after starting the engine, emission of at least one predetermined substance is measured from the exhaust gases of the engine, wherein at least until the engine has reached its operational temperature the cooling system of the engine is controlled to have effect on the temperature of the fuel and/or the fuel injection apparatus in order to control the at least one temperature-effected member providing a temperature-dependent restriction effect to the control fluid flow effecting on the position of the injector needle.

* * * * *